US009677315B2

(12) United States Patent
Fujimoto et al.

(10) Patent No.: US 9,677,315 B2
(45) Date of Patent: Jun. 13, 2017

(54) DOOR OPENING/CLOSING CONTROL DEVICE

(71) Applicants: Keigo Fujimoto, Aichi (JP); Sambon Lee, Aichi (JP); Masaaki Murata, Aichi (JP)

(72) Inventors: Keigo Fujimoto, Aichi (JP); Sambon Lee, Aichi (JP); Masaaki Murata, Aichi (JP)

(73) Assignee: OMRON AUTOMOTIVE ELECTRONICS CO., LTD., Aichi (JP)

( * ) Notice: Subject to any disclaimer, the term of this patent is extended or adjusted under 35 U.S.C. 154(b) by 15 days.

(21) Appl. No.: 14/668,177

(22) Filed: Mar. 25, 2015

(65) Prior Publication Data

US 2015/0275563 A1 Oct. 1, 2015

(30) Foreign Application Priority Data

Mar. 28, 2014 (JP) ..... 2014-068069
Jul. 28, 2014 (JP) ..... 2014-152719

(51) Int. Cl.
*E05F 15/00* (2015.01)
*E05F 15/60* (2015.01)
*E05F 15/75* (2015.01)

(52) U.S. Cl.
CPC ..... *E05F 15/60* (2015.01); *E05F 15/75* (2015.01); *E05Y 2800/113* (2013.01); *E05Y 2900/546* (2013.01); *Y10T 16/56* (2015.01)

(58) Field of Classification Search
CPC .... E05F 15/60; E05F 15/75; E05Y 2800/113; E05Y 2900/546; Y10T 16/56
See application file for complete search history.

(56) References Cited

U.S. PATENT DOCUMENTS 5,804,937 A * 9/1998 Sasajima ..... E05F 15/632 318/259
6,398,288 B1 6/2002 Yuge
(Continued)

FOREIGN PATENT DOCUMENTS

JP H05-149054 A 6/1993
JP H09-328961 A 12/1997
(Continued)

OTHER PUBLICATIONS

Office Action issued in corresponding Japanese Application No. 2014-152719, mailed on Feb. 16, 2017 (12 pages).

*Primary Examiner* — Katherine Mitchell
*Assistant Examiner* — Abe Massad
(74) *Attorney, Agent, or Firm* — Osha Liang LLP

(57) ABSTRACT

A door opening/closing control device includes: a driving part driving an actuator opening or closing a door; an operation switch operated for instructing opening/closing or stopping of the door; a first controller controlling driving of the actuator via the driving part in accordance with the operation; a manual opening/closing detector detecting that the door is manually opened or closed; and a second controller controlling the driving of the actuator via the driving part to assist a manual operation of opening or closing the door when the manual opening/closing detector detects the manual opening/closing operation. Then, when the second controller controls the driving of the actuator to assist the manual operation of opening or closing the door, even when the operation switch is operated, the first controller does not control the driving of the actuator in accordance with the operation, and the second controller continues to control the driving.

7 Claims, 9 Drawing Sheets

(56) References Cited

U.S. PATENT DOCUMENTS

| | | | | |
|---|---|---|---|---|
| 6,435,600 | B1 * | 8/2002 | Long | B60J 5/06 296/155 |
| 6,799,669 | B2 * | 10/2004 | Fukumura | F16D 48/06 180/286 |
| 7,026,777 | B2 * | 4/2006 | Matsui | E05F 7/04 318/443 |
| 8,755,975 | B2 * | 6/2014 | Oakley | E05F 15/20 318/282 |
| 8,875,442 | B2 * | 11/2014 | Sohn | E05F 15/124 49/138 |
| 2012/0179336 | A1 * | 7/2012 | Oakley | E05F 15/20 701/49 |

FOREIGN PATENT DOCUMENTS

| | | | |
|---|---|---|---|
| JP | 2001-132326 | A | 5/2001 |
| JP | 2002-242533 | A | 8/2002 |
| JP | 2006-299603 | A | 11/2006 |
| JP | 2007-327265 | A | 12/2007 |

* cited by examiner

DOOR OPENING/CLOSING CONTROL DEVICE

CROSS-REFERENCE TO RELATED APPLICATION

This application is based on Japanese Patent Application No. 2014-068069 filed with the Japan Patent Office on Mar. 28, 2014, and Japanese Patent Application No. 2014-152719 filed with the Japan Patent Office on Jul. 28, 2014, the entire contents of which are incorporated herein by reference.

FIELD

The disclosure relates to a door opening/closing control device that applies operation assisting force when an operation of opening or closing a door, such as a back door or a slide door of a vehicle, is manually performed.

BACKGROUND

As a door opening/closing control device that is mounted in a vehicle, for example, there are a power back door (also referred to as "power tail gate") control device, and a power slide door control device. In these door opening/closing control devices, as an actuator that opens or closes a door such as a back door or a slide door, a motor is used, for example. Further, a driver's seat and the back of a vehicle, a remote controller and the like are each provided with an operation switch that is operated for instructing opening/closing or stopping of the door.

Then, in accordance with an opening/closing operation of the operation switch, the door opening/closing control device rotates the motor and activates a door opening/closing mechanism, to automatically open or close the door (so-called auto-opening/closing function). Further, when the operation of opening or closing the door is manually performed, operation assisting force is applied by the motor so that an operator can perform the operation of opening or closing the door by small force (so-called power assisting function).

In a door opening/closing control device of Unexamined Japanese Patent Publication No. 2001-132326, in order to stop a back door at an arbitrary intermediate position between a fully closed position and a fully opened position, an operation content is judged based on the number of operation times of an operation switch, to selectively activate a driving measure and a braking measure for the back door. For example, by a first operation of the operation switch, the driving measure is activated to open or close the back door. By a second operation of the operation switch, the driving measure is stopped and the braking measure is activated, to stop the back door.

In a door opening/closing control device of Unexamined Japanese Patent Publication No. 2002-242533, an opening/closing operation force detector is provided at a door handle for manually operating a slide door. When opening/closing operation force is applied to the door handle during an automatic operation of opening or closing the slide door by driving of the motor, a duty ratio of the motor is increased in accordance with an output signal of the opening/closing operation force detector preferentially over the automatic opening/closing operation, to increase an opening/closing speed of the slide door.

In a door opening/closing control device of Unexamined Japanese Patent Publication No. 2006-299603, in order to restrain a back door from moving to a position against an intention, during an automatic operation of opening the back door by driving of the motor, an instruction of reversal in a moving direction by an operation of an operation switch is monitored. In a case where the reversal of the moving direction is instructed by the operation of the operation switch before the opening of the back door is completed, the moving direction of the back door is reversed (automatic closing operation) when the current opening angle of the back door is not smaller than a predetermined value, and the automatic operation of opening the back door is continued when the current opening angle is not larger than the predetermined value.

In the case of the operation switch being operated in a power assisting state, when the driving of the actuator is controlled in accordance with that operation, the door might move in a direction against the intention of the operator who is manually operating the door, thus causing a danger of nipping or the like. Further, the door might automatically move in the same direction as a direction of the manual operation of the door, thus bringing a feeling of strangeness to the operator who is performing the manual operation.

SUMMARY

One or more embodiments of the disclosure provide a door opening/closing control device which can improve the usability of the door by prioritizing a manual operation of opening or closing a door even when an operation switch is operated in a power assisting state.

A door opening/closing control device according to one or more embodiments of the disclosure includes: a driving part configured to drive an actuator that opens or closes a door; an operation switch configured to be operated for instructing opening/closing or stopping of the door; a first controller configured to control driving of the actuator via the driving part in accordance with the operation of the operation switch; a manual opening/closing detector configured to detect that the door is manually opened or closed; and a second controller configured to control the driving of the actuator via the driving part so as to assist a manual operation of opening or closing the door when the manual opening/closing detector detects the manual opening/closing operation. Then, at the time of the second controller controlling the driving of the actuator so as to assist the manual operation of opening or closing the door, even when the operation switch is operated, the first controller does not control the driving of the actuator in accordance with the operation, and the second controller continues to control the driving of the actuator.

According to the above, in a power assisting state where the second controller is controlling the driving of the actuator so as to assist the manual operation of opening or closing the door, even when the operation switch is operated, the first controller does not control the driving of the actuator in accordance with the switch operation, and the second controller continues to control the driving of the actuator. For this reason, the door does not move in a direction against the intention of the operator who is manually operating the door, thus eliminating the risk of incurring a danger of nipping or the like. Further, the door does not automatically move in the same direction as a direction of the manual operation of the door, thus eliminating the risk of bringing a feeling of strangeness to the operator who is performing the manual operation. From the above, it is possible to improve the usability of the door by prioritizing the manual operation of opening or closing the door even when the operation switch is operated in the power assisting state.

Further, in one or more embodiments of the disclosure, the above door opening/closing control device may include: a position detector configured to detect an opening/closing position of the door; a speed calculator configured to calculate an opening/closing speed of the door based on a temporal change in the opening/closing position detected by the position detector; and a target speed calculator configured to calculate a target speed based on the opening/closing position detected by the position detector. In this case, the first controller controls the driving of the actuator based on the opening/closing speed calculated by the speed calculator and the target speed calculated by the target speed calculator.

Further, in one or more embodiments of the disclosure, the above door opening/closing control device may include: a target assisting force calculator configured to calculate target assisting force based on the opening/closing position detected by the position detector and the opening/closing speed calculated by the speed calculator; and a current detector configured to detect a driving current of the actuator. In this case, the second controller controls the driving of the actuator based on the target assisting force calculated by the target assisting force calculator and the driving current detected by the current detector.

Further, in one or more embodiments of the disclosure, in the above door opening/closing control device, at the time of the first controller controlling the driving of the actuator so as to perform the operation of opening or closing the door in accordance with the operation of the operation switch, when the operation switch is re-operated, the first controller may control the driving of the actuator in accordance with the re-operation.

Further, in one or more embodiments of the disclosure, the above door opening/closing control device may include: a remote controller which is provided with the operation switch and configured to wirelessly transmit an operation signal that shows an operating state of the operation switch; and a communication part configured to receive the operation signal transmitted from the remote controller. In this case, when the communication part receives the operation signal from the remote controller, unless the second controller is controlling the driving of the actuator so as to assist the manual operation of opening or closing the door, the first controller may control the driving of the actuator in accordance with the operation signal.

Further, in one or more embodiments of the disclosure, the above door opening/closing control device may control opening/closing of the door provided on a vehicle, and may further include a traveling state detector configured to detect whether or not the vehicle is traveling based on information concerning traveling and stopping of the vehicle, the information having been acquired from a vehicle-side device. In this case, at the time of the traveling state detector detecting non-traveling of the vehicle and the second controller controlling the driving of the actuator so as to assist the manual operation of opening or closing the door, even when the operation switch is operated, the first controller does not control the driving of the actuator in accordance with the operation, and the second controller continues to control the driving of the actuator. Further, at the time of the traveling state detector detecting non-traveling of the vehicle and the second controller not controlling the driving of the actuator so as to assist the manual operation of opening or closing the door, when the operation switch is operated, the first controller controls the driving of the actuator in accordance with the operation. Moreover, at the time of the traveling state detector detecting traveling of the vehicle, when the operation switch is operated, the first controller controls the driving of the actuator in accordance with the operation.

Further, in one or more embodiments of the disclosure, in the above door opening/closing control device, the operation switch may be provided in at least each of an operation part in the driver's seat and the remote controller of the vehicle. In this case, at the time of the traveling state detector detecting traveling of the vehicle, the first controller controls the driving of the actuator in accordance with the operation of the operation switch of the operation part in the drivers seat. Further, at the time of the traveling state detector detecting non-traveling of the vehicle and the second controller not controlling the driving of the actuator so as to assist the manual operation of opening or closing the door, the first controller controls the driving of the actuator in accordance with an operation of the operation switch of the operation part in the driver's seat or of the operation switch of the remote controller.

According to one or more embodiments of the disclosure, it is possible to provide a door opening/closing control device which can improve the usability of a door by prioritizing a manual operation of opening or closing the door even when an operation switch is operated in a power assisting state.

DETAILED DESCRIPTION

Hereinafter, embodiments of the disclosure will be described with reference to the drawings. In the respective drawings, the same portions or the corresponding portions are provided with the same numeral. In embodiments of the disclosure, numerous specific details are set forth in order to provide a more through understanding of the invention. However, it will be apparent to one of ordinary skill in the art that the invention may be practiced without these specific details. In other instances, well-known features have not been described in detail to avoid obscuring the invention.

First, a configuration of one or more embodiments of the disclosure will be described with reference to FIGS. 1 and 2.

Figure 1:
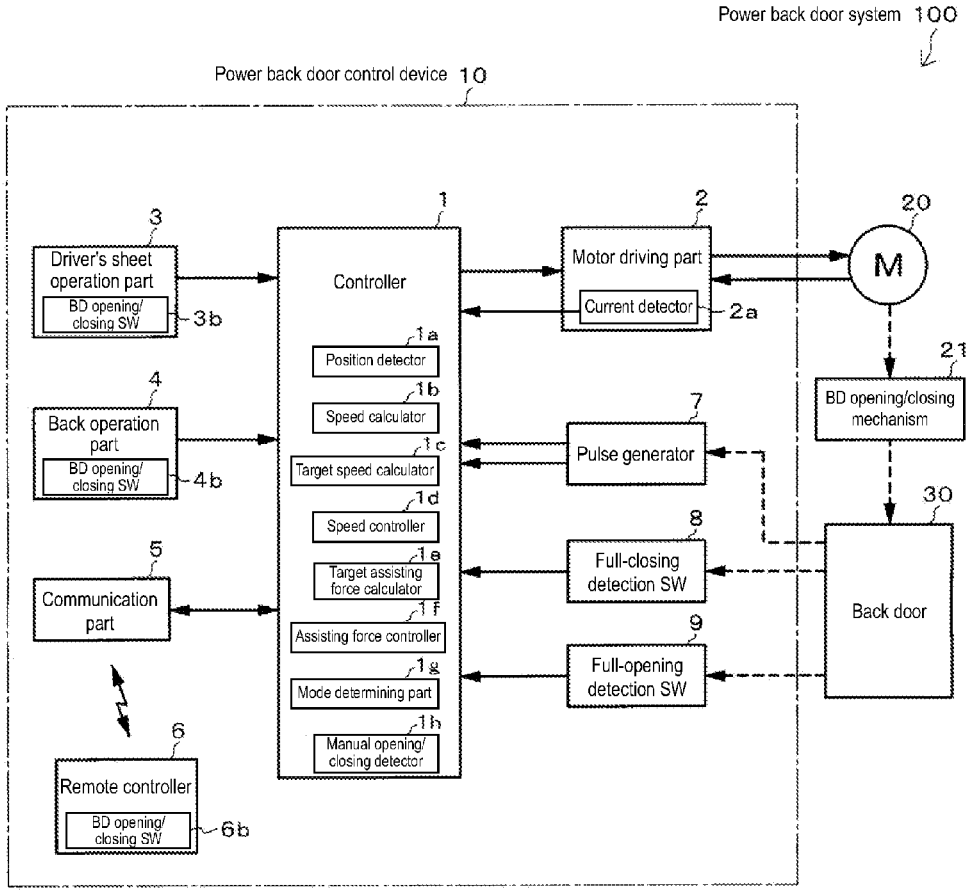
FIG. 1 is a diagram showing a configuration of a power back door control device according to one or more embodiments of the disclosure.

FIG. 1 is a diagram showing a configuration of a power back door control device 10. FIG. 2 is a view showing one example of a back door 30.

In FIG. 1, the power back door control device 10 is incorporated into a power back door system 100 along with a motor 20, a BD (back door) opening/closing mechanism 21 and the back door 30. This power back door system 100 is mounted in an automatic four-wheel car.

Figure 2:
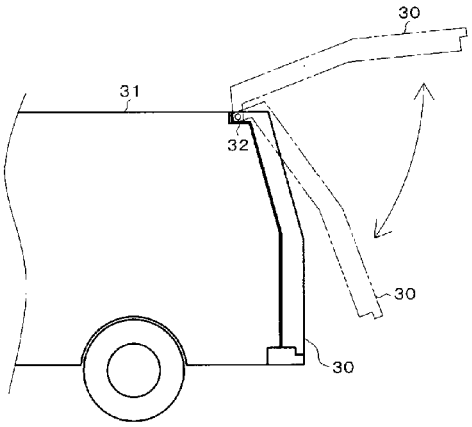
FIG. 2 is a view showing one example of a back door.

The power back door control device 10 is provided in a car body 31 of FIG. 2. The BD opening/closing function 21 for opening/closing the back door 30 is provided in the car body 31 and the back door 30. The motor 20 is a power source of the BD opening/closing function 21, and provided in the car body 31.

As shown in FIG. 2, the back door 30 is made up of a flip-up door provided on the back surface of the car body 31 of the automatic four-wheel car. The back door 30 is getting open by its lower end swinging upward around a rotation axis 32 located at its upper end, and is conversely getting closed by its lower end swinging downward. In FIG. 2, the back door 30 being at the fully closed position is indicated by a solid line. The back door 30 being at the fully opened position is indicated by a dashed line. The back door 30 being at the intermediate position between the fully closed position and the fully opened position is indicated by a chain double-dashed line. The power back door control device 10 activates the BD opening/closing function 21 by driving the motor 20 by normal rotation or reverse rotation, to automatically open or close the back door 30 (auto-opening/closing function).

Further, it is possible to manually perform the operation of opening or closing of the back door 30 by holding its lower end or gripper (not shown). When the operation of opening or closing the back door 30 is manually performed, the power back door control device 10 applies operation assisting force by the motor 20, to allow an operator to perform the operation of opening or closing the back door 30 by small force (power assisting function).

The power back door control device 10 is one example of the "door opening/closing control device" of the disclosure. The back door 30 is one example of the "door" of the disclosure. The motor 20 is one example of the "actuator" of the disclosure.

The power back door control device 10 is provided with a controller 1, a motor driving part 2, a driver's seat operation part 3, a back operation part 4, a communication part 5, a remote controller 6, a pulse generator 7, a full-closing detection SW (switch) 8, and a full-opening detection SW (switch) 9.

The controller 1 is made up of a microcomputer. The controller 1 is provided with a position detector 1*a*, a speed calculator 1*b*, a target speed calculator 1*c*, a speed controller 1*d*, a target assisting force calculator 1*e*, an assisting force controller 1*f*, a mode determining part 1*g*, and a manual opening/closing detector 1*h*.

The motor driving part 2 is made up of a drive circuit for driving the motor 20 by a PWM (Pulse Width Modulation) signal. The motor driving part 2 is one example of the "driving part" of the disclosure.

The controller 1 controls driving of the motor 20 by the motor driving part 2. The motor driving part 2 is provided with a current detector 2*a* for detecting an electric current flowing in the motor 20 (hereinafter referred to as "motor current"). The detection of the motor current by the current detector 2*a* is performed suitably or in a predetermined period.

The drivers seat operation part 3 is made up of a switch, a button and the like provided at the driver's seat of the automatic four-wheel car. The back operation part 4 is made up of a switch, a button, and the like provided at the back of the car body 31 (outside the car). The driver's seat operation part 3 and the back operation part 4 are respectively provided with BD opening/closing SWs (switches) 3*b*, 4*b* that are operated for instructing opening/closing or stopping of the back door 30.

The communication part 5 is provided with an antenna and a circuit for performing wireless communications (communications by a LF (Low Frequency) signal, a UHF (Ultra High Frequency), etc.) with the remote controller 6. The remote controller 6 is made up of an FOB key of a passive entry system, and carried by a user.

The remote controller 6 is also provided with a BD opening/closing SW (switch) 6*b* that is operated for instructing opening/closing or stopping of the back door 30. When the user operates the BD opening/closing SW 6*b*, the remote controller 6 wirelessly transmits an operation signal showing its operating state, and the communication part 5 receives that operation signal. The BD opening/closing SWs 3*b*, 4*b*, 6*b* are one example of the "operation switch" of the disclosure.

The pulse generator 7 is, for example, made up of a two-phase rotary encoder, and is provided in the motor 20 or the BD opening/closing function 21. The pulse generator 7 outputs two pulse signals with shifted phases to the controller 1 in accordance with a rotating state of the motor 20 or an operating state of the BD opening/closing function 21.

The rotating state of the motor 20, the operating state of the BD opening/closing function 21 and the opening/closing state of the back door 30 are interlocked. For this reason, the position detector 1*a* of the controller 1 detects two pulse signals outputted from the pulse generator 7, and detects an opening/closing position of the back door 30 (hereinafter referred to as "door position") based on the pulse signals. The speed calculator 1*b* calculates an opening/closing speed of the back door 30 (hereinafter referred to as "door speed") based on a temporal change in the door position detected by the position detector 1*a*. The detection of the door position by the position detector 1*a* and the calculation of the door speed by the speed calculator 1*b* are performed suitably or in a predetermined cycle as needed.

The full-closing detection SW (switch) 8 and the full-opening detection SW (switch) 9 are provided at the back of the car body 31. The full-closing detection SW 8 detects that the back door 30 is fully closed and outputs a detection signal to the controller 1. The full-opening detection SW 9 detects that the back door 30 is fully opened and outputs a detection signal to the controller 1. The position detector 1*a* detects that the back door 30 is at a fully closed position or a fully opened position based on the output signal from the full-closing detection SW 8 or the full-opening detection SW 9.

The controller 1 controls the driving of the motor 20 via the motor driving part 2 in accordance with an operation of the BD opening/closing SW 3*b*, 4*b*, 6*b*. Specifically, the controller 1 rotates the motor 20 by the motor driving part 2 in accordance with an opening/closing operation of the BD opening/closing SW 3*b*, 4*b*, 6*b*, and the controller 1 stops the motor 20 by the motor driving part 2 in accordance with a stopping operation of the BD opening/closing SW 3*b*, 4*b*, 6*b*. Thereby, the back door 30 automatically opens or closes, or stops.

At the time of driving the motor 20 in accordance with the opening/closing operation of the BD opening/closing SW 3*b*, 4*b*, 6*b*, the target speed calculator 1*c* calculates a target speed for automatically opening or closing the back door 30 based on the door position detected by the position detector 1*a*. The speed controller 1*d* then controls a speed of the motor 20 based on that target speed and the door speed calculated by the speed calculator 1*b*. The controller 1 and the speed controller 1*d* are one example of the "first controller" of the disclosure.

Based on the door speed calculated by the speed calculator 1*b*, the manual opening/closing detector 1*h* detects that the operation of opening or closing the back door 30 is manually performed. Specifically, when the speed controller 1*d* is not controlling the driving of the motor 20, unless the door speed calculated by the speed calculator 1*b* becomes 0, the manual opening/closing detector 1*h* determines that the operation of opening or closing the back door 30 is manually performed.

When the manual opening/closing detector 1*h* detects the manual operation of opening or closing the back door 30, the controller 1 controls the driving of the motor 20 via the motor driving part 2 so as to assist the manual operation of opening or closing the back door 30. Specifically, the target assisting force calculator 1*e* calculates target assisting force based on the door position detected by the position detector 1*a* and the door speed calculated by the speed calculator 1*b*. The assisting force controller 1*f* controls the driving of the motor 20 via the motor driving part 2 based on that target assisting force and the motor current detected by the current detector 2*a*. The controller 1 and the assisting force controller 1*f* are one example of the "second controller" of the disclosure.

The mode determining part 1*g* determines a mode for controlling the motor 20 based on the door position detected by the position detector 1*a*, the door speed calculated by the speed calculator 1*b* and operating states of the BD opening/closing SWs 3*b*, 4*b*, 6*b*.

Next, an operation of the power back door control device 10 will be described with reference to FIGS. 3 to 10.

Figure 3:
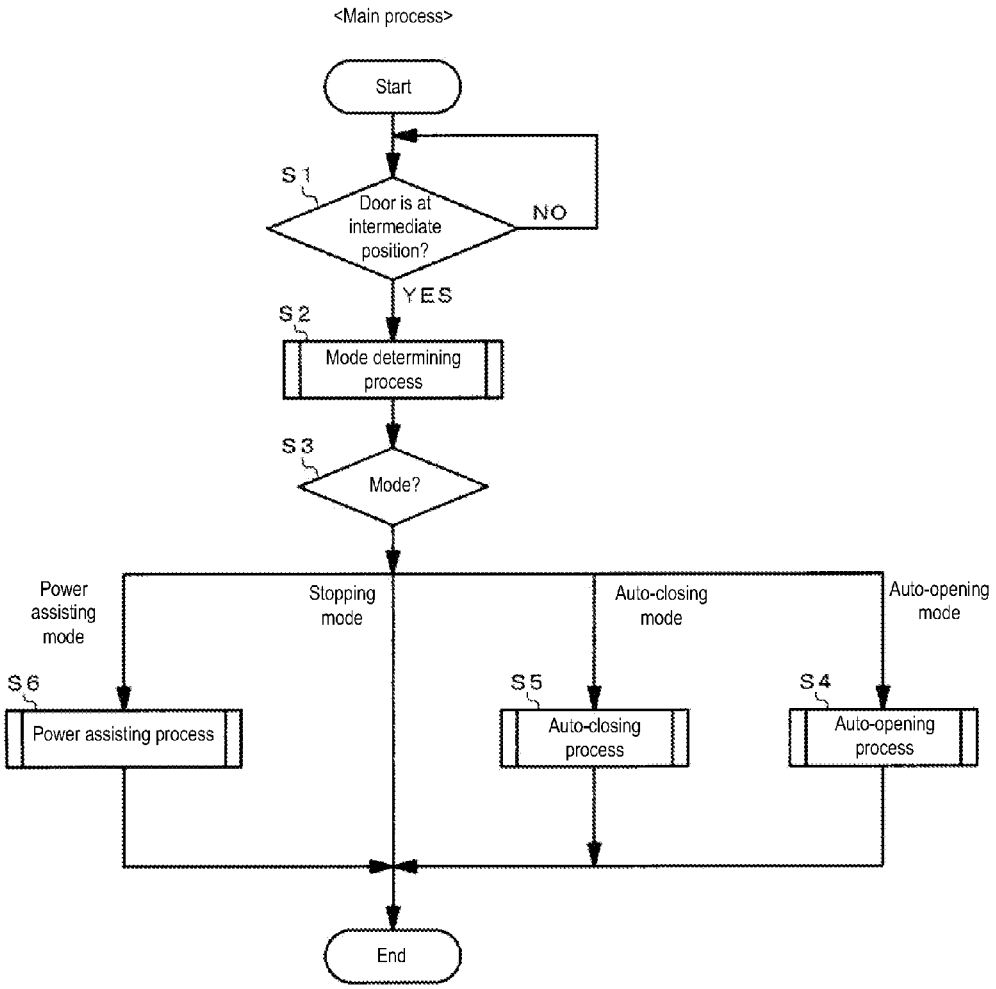
FIG. 3 is a flowchart showing a main process of the power back door control device of FIG. 1.

FIG. 3 is a flowchart showing a main process of the power back door control device 10. When the controller 1 judges that the back door 30 is at the intermediate position being between the fully closed position and the fully opened position from the door position detected in the position detector 1*a* (Step S1 of FIG. 3: YES), the controller 1 performs a mode determining process by the mode determining part 1*g* (Step S2 of FIG. 3).

Figure 4:
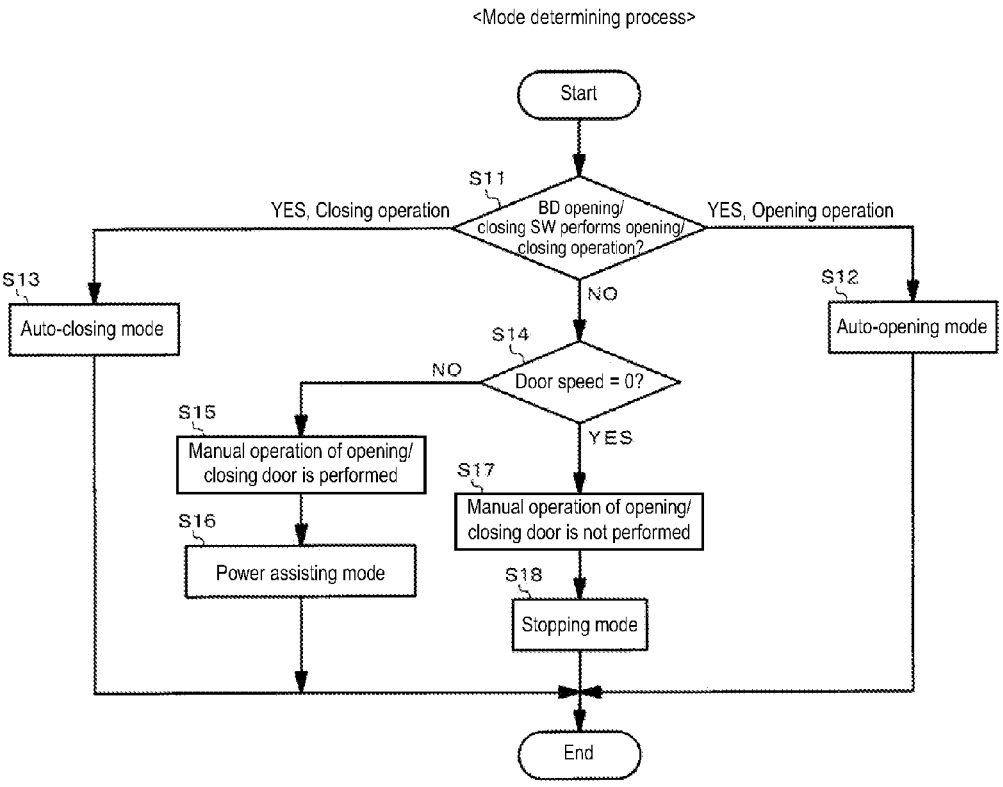
FIG. 4 is a flowchart showing a detail of a mode determining process of FIG. 3.

FIG. 4 is a flowchart showing a detail of the mode determining process. When the opening operation is performed in any of the BD opening/closing SWs 3*b*, 4*b*, 6*b* (Step S11 of FIG. 4: YES, auto-opening operation), the mode determining part 1*g* determines that a switching destination is an auto-opening mode (Step S12 of FIG. 4). Further, when the closing operation is performed in any of the BD opening/closing SWs 3*b*, 4*b*, 6*b* (Step S11 of FIG. 4: YES, auto-closing operation), the mode determining part 1*g* determines that the switching destination is an auto-closing mode (Step S13 of FIG. 4).

Further, in a state where the auto-opening/closing operation is not performed in the BD opening/closing SWs 3*b*, 4*b*, 6*b* (Step S11 of FIG. 4: NO), when the operation of opening or closing the back door 30 is manually performed, the door speed calculated in the speed calculator 1*b* becomes a value other than 0 (Step S14 of FIG. 4: NO). Accordingly, the manual opening/closing detector 1*h* judges that the manual operation of opening or closing the back door 30 is performed (Step S15 of FIG. 4), and the mode determining part 1*g* determines that the switching destination is a power assisting mode (Step S16 of FIG. 4).

Further, in a state where the auto-opening/closing operation is not performed in the BD opening/closing SWs 3*b*, 4*b*, 6*b* (Step S11 of FIG. 4: NO), when the operation of opening or closing the back door 30 is not manually performed and the back door 30 stands still, the door speed calculated in the speed calculator 1*b* becomes 0 (Step S14 of FIG. 4: YES). Accordingly, the manual opening/closing detector 1*h* judges that the manual operation of opening or closing the back door 30 is not performed (Step S17 of FIG. 4), and the mode determining part 1*g* determines that the switching destination is a stopping mode (Step S18 of FIG. 4).

Further, also in a case where the stopping operation is performed in any of the BD opening/closing SWs 3*b*, 4*b*, 6*b* (Step S11 of FIG. 4: NO), when the door speed becomes 0 (Step S14 of FIG. 4: YES), the mode determining part 1*g* determines that the switching destination is a stopping mode (Step S18 of FIG. 4).

When the mode is switched from Step S3 of FIG. 3 to the stopping mode in accordance with a result of the judgment in the mode determining process of FIG. 4, the controller 1 completes the main process without driving the motor 20. Accordingly, the back door 30 remains standing still at the intermediate position.

Further, when the mode is switched from Step S3 of FIG. 3 to the auto-opening mode in accordance with a result of the judgment in the mode determining process of FIG. 4, the controller 1 executes an auto-opening process (Step S4 of FIG. 3).

Figure 5:
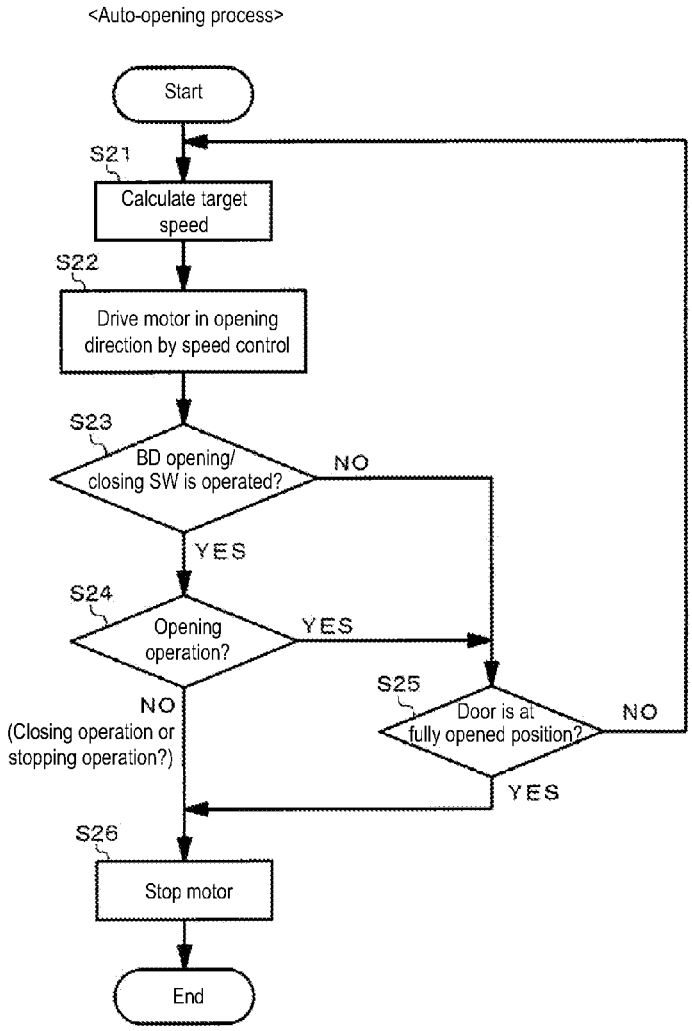
FIG. 5 is a flowchart showing a detail of an auto-opening process of FIG. 3.
Figure 7:
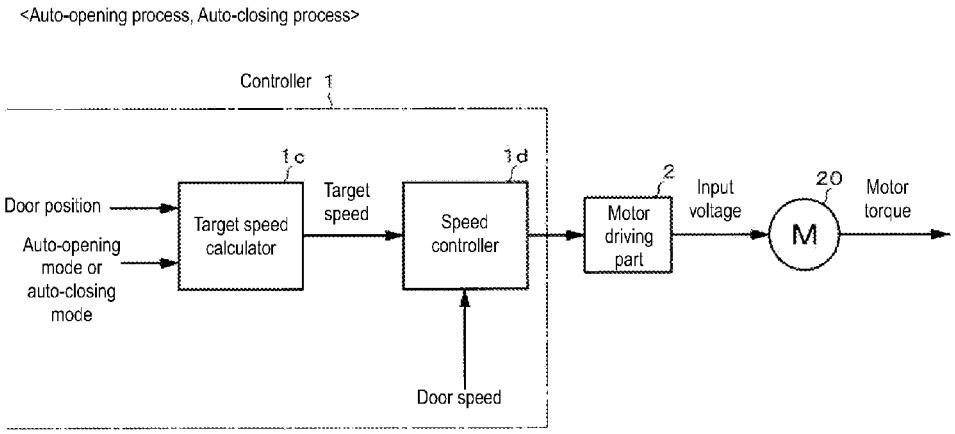
FIG. 7 is a block diagram showing a detail of the auto-opening process and the auto-closing process of FIG. 3.

FIG. 5 is a flowchart showing a detail of the auto-opening process. FIG. 7 is a block diagram showing a detail of the auto-opening process and an auto-closing process. When the auto-opening process is started, as shown in FIG. 7, the target speed calculator 1*c* calculates a target speed based on the door position detected in the position detector 1*a* (Step S21 of FIG. 5). Next, the speed controller 1*d* drives the motor 20 in an opening direction (e.g., normal rotation) while performing speed control (Step S22 of FIG. 5).

Specifically, the speed controller 1*d* controls an input voltage into the motor 20 by the motor driving part 2 such that the target speed calculated in the target speed calculator 1*c* agrees with the door speed calculated in the speed calculator 1*b*, to drive the motor 20 in the opening direction. This activates the BD opening/closing function 21, and the back door 30 is automatically getting open.

Thereafter, when the BD opening/closing SWs 3*b*, 4*b*, 6*b* are not operated (Step S23 of FIG. 5: NO), the processes of Steps S21 to S25 are repeated until the back door 30 reaches the fully opened position (Step S25 of FIG. 5: NO).

Further, even when any of the BD opening/closing SWs 3*b*, 4*b*, 6*b* is operated (Step S23 of FIG. 5: YES), if that is the opening operation (Step S24 of FIG. 5: YES), the processes of Steps S21 to S25 are repeated until the back door 30 reaches the fully opened position (Step S25 of FIG. 5: NO).

Moreover, when any of the BD opening/closing SWs 3*b*, 4*b*, 6*b* is operated (Step S23 of FIG. 5: YES) and it is an operation (closing operation or stopping operation) other than the opening operation (Step S24 of FIG. 5: NO), the previously accepted opening operation becomes invalid. Accordingly, the controller 1 stops the driving of the motor 20 (Step S26 of FIG. 5), to complete the auto-opening process. Subsequently, the main process of FIG. 3 is executed again, and the mode is switched to a mode (auto-closing mode or stopping mode) in accordance with the operation of the BD opening/closing SW 3*b*, 4*b*, 6*b*. As another example, in Step S23 of FIG. 5, in a case where the BD opening/closing SW 3*b*, 4*b*, 6*b* is operated, no matter whether the operation is the opening operation or the closing operation, the driving of the motor 20 may be once stopped or the rotating direction of the motor 20 may be reversed.

Further, it is assumed that an operation other than the opening operation is not performed in the BD opening/closing SWs 3*b*, 4*b*, 6*b* (Step S23 of FIG. 5: NO or Step S24: YES) and the back door 30 reaches the fully opened position. Then, the controller 1 judges that the back door 30 is at the fully opened position based on the door position detected in the position detector 1*a* (Step S25 of FIG. 5: YES). The controller 1 then stops the driving of the motor 20 (Step S26 of FIG. 5), to complete the auto-opening process.

In contrast, when the mode is switched from Step S3 of FIG. 3 to the auto-closing mode in accordance with a result of the judgment in the mode determining process of FIG. 4, the controller 1 executes an auto-closing process (Step S5 of FIG. 3).

Figure 6:
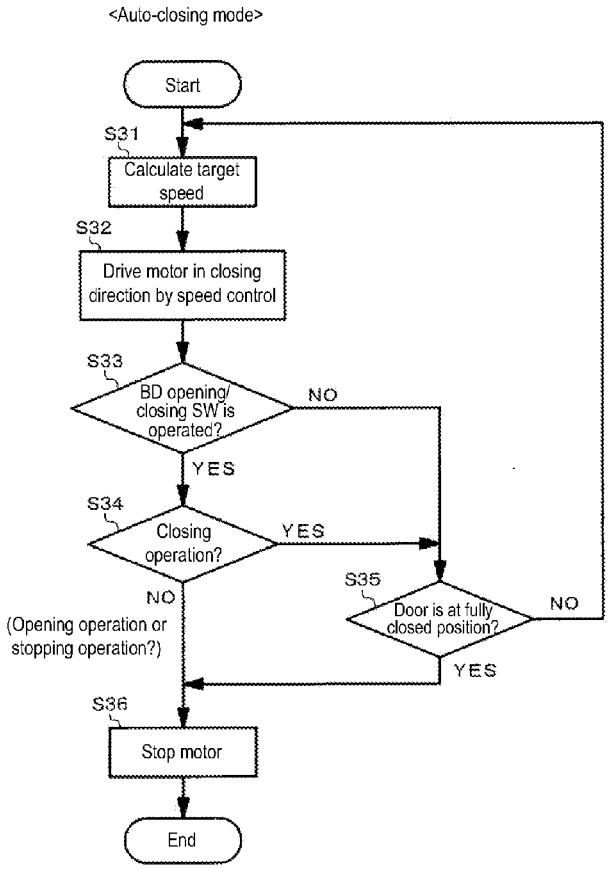
FIG. 6 is a flowchart showing a detail of an auto-closing process of FIG. 3.

FIG. 6 is a flowchart showing a detail of the auto-closing process. When the auto-closing process is started, as shown in FIG. 7, the target speed calculator 1*c* calculates a target speed based on the door position detected in the position detector 1*a* (Step S31 of FIG. 6). Next, the speed controller 1*d* drives the motor 20 in a closing direction (e.g., reverse rotation) while performing speed control (Step S32 of FIG. 6).

Specifically, the speed controller 1*d* controls an input voltage into the motor 20 by the motor driving part 2 such that the target speed calculated in the target speed calculator 1*c* agrees with the door speed calculated in the speed calculator 1*b*, to drive the motor 20 in the closing direction. This activates the BD opening/closing function 21, and the back door 30 is automatically getting closed.

Thereafter, when the BD opening/closing SWs 3*b*, 4*b*, 6*b* are not operated (Step S33 of FIG. 6: NO), the processes of Steps S31 to S35 are repeated until the back door 30 reaches the fully closed position (Step S35 of FIG. 6: NO).

Further, even when any of the BD opening/closing SWs 3*b*, 4*b*, 6*b* is operated (Step S33 of FIG. 6: YES), if that is the closing operation (Step S34 of FIG. 6: YES), the processes of Steps S31 to S35 are repeated until the back door 30 reaches the fully closed position (Step S35 of FIG. 6: NO).

Moreover, when any of the BD opening/closing SWs 3*b*, 4*b*, 6*b* is operated (Step S33 of FIG. 6: YES) and it is an operation (opening operation or stopping operation) other than the closing operation (Step S34 of FIG. 6: NO), the previously accepted closing operation becomes invalid. Accordingly, the controller 1 stops the driving of the motor 20 (Step S36 of FIG. 6), to complete the auto-closing process. Subsequently, the main process of FIG. 3 is executed again, and the mode is switched to a mode (auto-opening mode or stopping mode) in accordance with the operation of the BD opening/closing SW 3*b*, 4*b*, 6*b*. As another example, in Step S33 of FIG. 6, in a case where the BD opening/closing SW 3*b*, 4*b*, 6*b* is operated, no matter whether the operation is the opening operation or the closing operation, the driving of the motor 20 may be once stopped or the rotating direction of the motor 20 may be reversed.

Further, it is assumed that an operation other than the closing operation is not performed in the BD opening/closing SWs 3*b*, 4*b*, 6*b* (Step S33 of FIG. 6: NO or Step S34: YES) and the back door 30 reaches the fully closed position. Then, the controller 1 judges that the back door 30 is at the fully closed position based on the door position detected in the position detector 1*a* (Step S35 of FIG. 6: YES). The controller 1 then stops the driving of the motor 20 (Step S36 of FIG. 6), to complete the auto-closing process.

In contrast, when the mode is switched from Step S3 of FIG. 3 to the power assisting mode in accordance with a result of the judgment in the mode determining process of FIG. 4, the controller 1 executes a power assisting process (Step S6 of FIG. 3).

Figure 8:
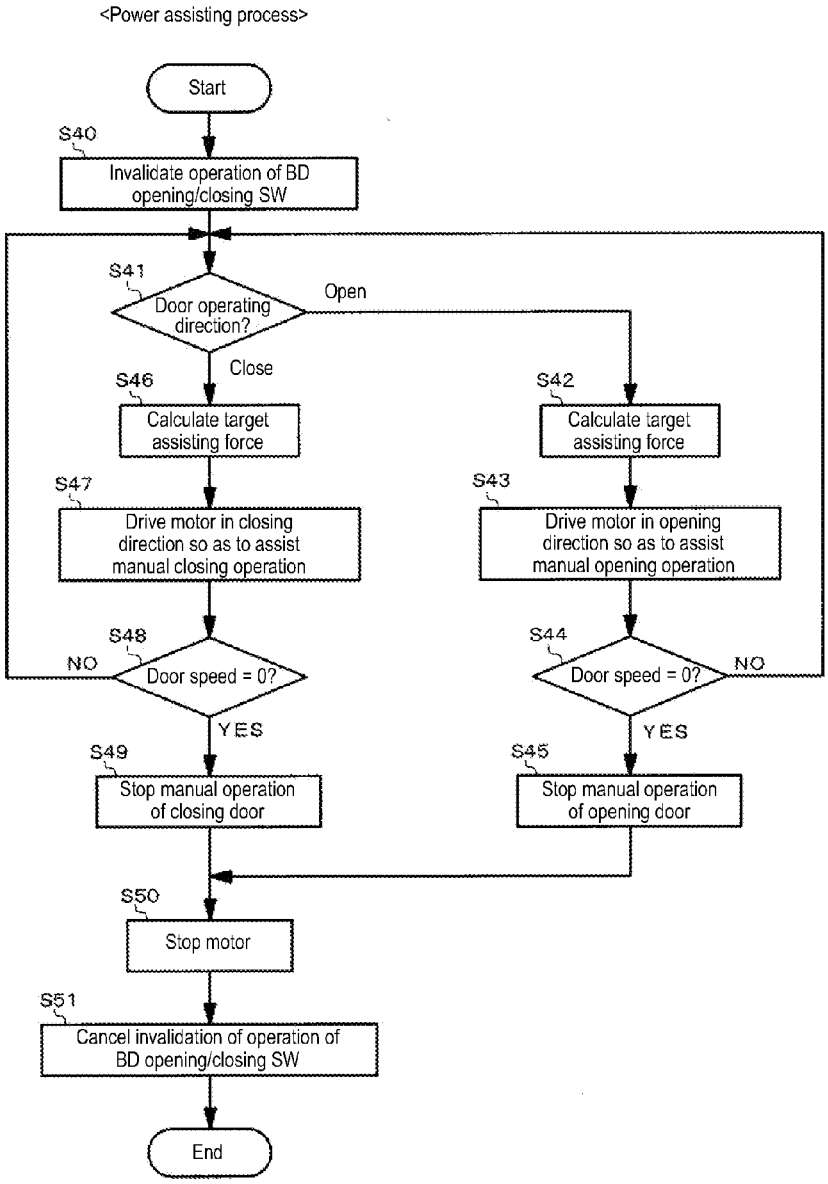
FIG. 8 is a flowchart showing a detail of a power assisting process of FIG. 3.
Figure 9:
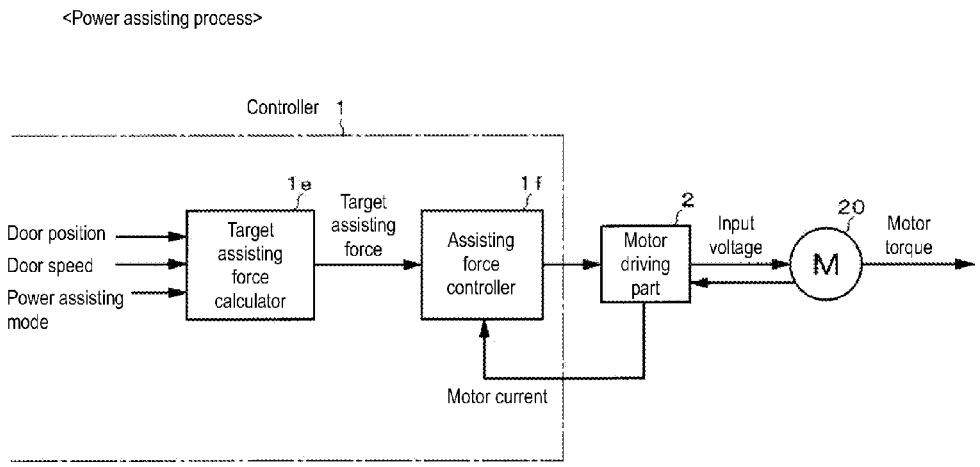
FIG. 9 is a block diagram showing a detail of the power assisting process of FIG. 3.
Figure 10:
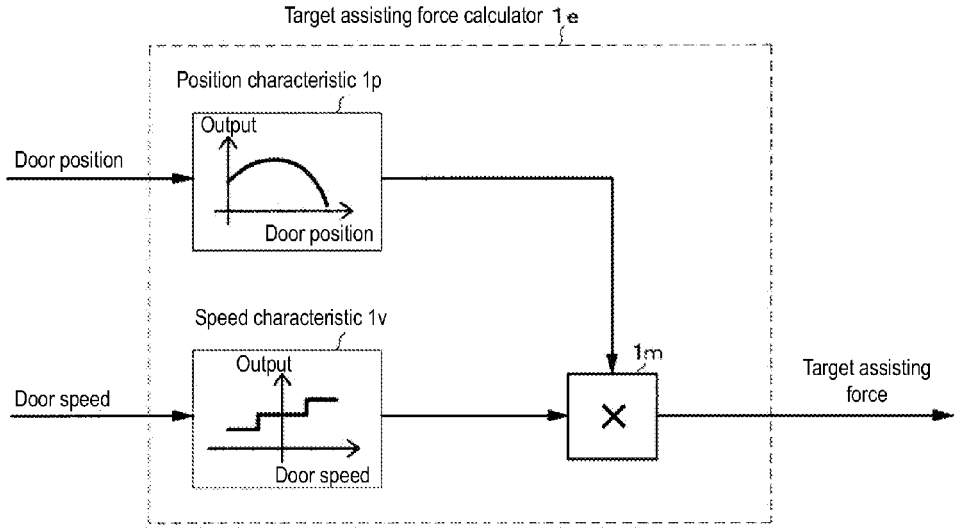
FIG. 10 is a diagram showing a detail of a target assisting force calculator of FIG. 9.

FIG. 8 is a flowchart showing a detail of the power assisting process. FIG. 9 is a block diagram showing a detail of the power assisting process. FIG. 10 is a block diagram showing a detail of the target assisting force calculator 1*e*. When starting the power assisting process, the controller 1 first invalidates the operation of the BD opening/closing SW 3*b*, 4*b*, 6*b* (Step S40 of FIG. 8). Accordingly, from hereon, even when any of the BD opening/closing SWs 3*b*, 4*b*, 6*b* is operated, that operation is ignored in the controller 1.

Next, the controller 1 judges the operating direction (opening/closing direction) of the back door 30 based on a temporal change in the door position detected in the position detector 1*a* (Step S41 of FIG. 8). At this time, when the controller 1 judges that the operating direction of the back door 30 is the opening direction (Step S41 of FIG. 8: Open), as shown in FIG. 9, the target assisting force calculator 1*e* calculates target assisting force for the opening operation based on the door position detected in the position detector 1*a* and the door speed calculated in the speed calculator 1*b* (Step S42 of FIG. 8).

Specifically, as shown in FIG. 10, the target assisting force calculator 1*e* is provided with a position characteristic 1*p* showing an assisting force component in accordance with a door position, a speed characteristic 1*v* showing an assisting force component in accordance with a door speed, and a multiplier 1*m*. When the door position detected in the position detector 1*a* is inputted, an assisting force component in accordance with the door position is outputted by the position characteristic 1*p*. Further, when the door speed calculated in the speed calculator 1*b* is inputted, an assisting force component in accordance with the door speed is outputted by the speed characteristic 1*v*. Then, these two assisting force components are multiplied in the multiplier 1*m*, and target assisting force is thereby calculated.

When the target assisting force for the opening operation is calculated in the target assisting force calculator 1*e*, as shown in FIG. 9, the assisting force controller 1*f* drives the motor 20 in the opening direction so as to assist the manual operation of opening the back door 30 based on the above target assisting force and the motor current detected in the current detector 2*a* (Step S43 of FIG. 8).

Specifically, the assisting force controller 1*f* controls an input voltage into the motor 20 by the motor driving part 2 in accordance with the target assisting force and the motor current, to drive the motor 20 in the opening direction. Accordingly, a motor torque outputted from the motor 20 serves as the operation assisting force, thus leading to reduction in operation force at the time of the operator manually opening the back door 30.

As described above, at the time of the controller 1 controlling the driving of the motor 20 by the assisting force controller 1*f* so as to assist the manual operation of closing the back door 30, even when the BD opening/closing SW 3*b*, 4*b*, 6*b* is operated, that operation is invalidated (Step S40). Accordingly, the controller 1 does not control the driving of the motor 20 by the speed controller 1*d* in accordance with the operation of the BD opening/closing SW 3*b*, 4*b*, 6*b*, but continues to control the driving of the motor 20 in the opening direction by the assisting force controller 1*f*.

Thereafter, when the operator stops the manual operation of opening the back door 30, the door speed calculated in the speed calculator 1*b* becomes 0 (Step S44 of FIG. 8: YES). Hence the manual opening/closing detector 1*h* determines that the manual operation of opening the back door 30 is stopped (Step S45 of FIG. 8), and the controller 1 stops the driving of the motor 20 (Step S50 of FIG. 8). Accordingly, the back door 30 stands still at the intermediate position between the fully closed position and the fully opened position. The controller 1 then cancels the invalidation of the operation of the BD opening/closing SW 3*b*, 4*b*, 6*b* (Step S51 of FIG. 8), to complete the power assisting process. Accordingly, from hereon, the controller 1 accepts the operation of each of the BD opening/closing SWs 3*b*, 4*b*, 6*b*. Thereafter, the main process of FIG. 3 is executed again.

Further, when the operator continues the manual operation of opening the back door 30, the door speed becomes a value other than 0 (e.g., +value) (Step S44 of FIG. 8: NO). In this case, the processes of Steps S41 to S44 of FIG. 8 are repeated. Subsequently, when the back door 30 reaches the fully opened position, the door speed becomes 0 (Step S44 of FIG. 8: YES). Hence the manual opening/closing detector 1*h* determines that the manual operation of opening the back door 30 is stopped (Step S45 of FIG. 8). The controller 1 then stops the driving of the motor 20 (Step S50 of FIG. 8) and cancels the invalidation of the operation of the BD opening/closing SW 3*b*, 4*b*, 6*b* (Step S51 of FIG. 8), to complete the power assisting process.

Further, immediately after the start of the power assisting process, when the controller 1 judges that the operating direction of the back door 30 is the closing direction (Step S41 of FIG. 8: Close), as shown in FIG. 9, the target assisting force calculator 1*e* calculates target assisting force for the closing operation based on the door position detected in the position detector 1*a* and the door speed calculated in the speed calculator 1*b* (Step S46 of FIG. 8).

Also at this time, as shown in FIG. 10, in the target assisting force calculator 1*e*, an assisting force component in accordance with the door position is outputted by the position characteristic 1*p* and an assisting force component in accordance with the door speed is outputted by the speed characteristic 1*v*. Then, these two assisting force components are multiplied in the multiplier 1*m*, and target assisting force is thereby calculated. It is to be noted that the position characteristic 1*p* and the speed characteristic 1*v* for the closing operation may be different from the position characteristic 1*p* and the speed characteristic 1*v* for the opening operation, or may be the same as those.

When the target assisting force for the closing operation is calculated in the target assisting force calculator 1*e*, as shown in FIG. 9, the assisting force controller 1*f* drives the motor 20 in the closing direction so as to assist the manual operation of closing the back door 30 based on the above target assisting force and the motor current (Step S47 of FIG. 8).

Specifically, the assisting force controller 1*f* controls an input voltage into the motor 20 by the motor driving part 2 in accordance with the target assisting force and the motor current, to drive the motor 20 in the closing direction. Accordingly, a motor torque outputted from the motor 20 serves as operation assisting force, thus leading to reduction in operation force at the time of the operator manually closing the back door 30.

As described above, at the time of the controller 1 controlling the driving of the motor 20 by the assisting force controller 1*f* so as to assist the manual operation of closing the back door 30, even when the BD opening/closing SW 3*b*, 4*b*, 6*b* is operated, that operation is invalidated (Step S40). Accordingly, the controller 1 does not control the driving of the motor 20 by the speed controller 1*d* in accordance with the operation of the BD opening/closing SW 3*b*, 4*b*, 6*b*, but continues to control the driving of the motor 20 in the closing direction by the assisting force controller 1*f*.

Thereafter, when the operator stops the manual operation of closing the back door 30, the door speed calculated in the speed calculator 1*b* becomes 0 (Step S48 of FIG. 8: YES). Hence the manual opening/closing detector 1*h* determines that the manual operation of closing the back door 30 is stopped (Step S49 of FIG. 8), and the controller 1 stops the driving of the motor 20 (Step S50 of FIG. 8). Accordingly, the back door 30 stands still at the intermediate position. The controller 1 then cancels the invalidation of the operation of the BD opening/closing SW 3*b*, 4*b*, 6*b* (Step S51 of FIG. 8), to complete the power assisting process. Accordingly, from hereon, the controller 1 accepts the operation of each of the BD opening/closing SWs 3*b*, 4*b*, 6*b*. Thereafter, the main process of FIG. 3 is executed again.

Further, when the operator continues the manual operation of closing the back door 30, the door speed becomes a value other than 0 (e.g., −value) (Step S48 of FIG. 8: NO). In this case, the processes of Steps S41 and S46 to S48 of FIG. 8 are repeated. Subsequently, when the back door 30 reaches the fully closed position, the door speed becomes 0 (Step S48 of FIG. 8: YES). Hence the manual opening/closing detector 1*h* determines that the manual operation of closing the back door 30 is stopped (Step S49 of FIG. 8). The controller 1 then stops the driving of the motor 20 (Step S50 of FIG. 8) and cancels the invalidation of the operation of the BD opening/closing SW 3*b*, 4*b*, 6*b* (Step S51 of FIG. 8), to complete the power assisting process.

According to an illustrative embodiment, in a power assisting state where the assisting force controller 1*f* controls the driving of the motor 20 so as to assist the manual operation of opening or closing the back door 30, even when the BD opening/closing SW 3*b*, 4*b*, 6*b* is operated, the power assisting state is continued. That is, the driving of the motor 20 is not controlled by the speed controller 1*d* in accordance with the operation of the BD opening/closing SW 3*b*, 4*b*, 6*b*, and the back door 30 does not automatically open, close or stop. For this reason, the back door 30 does not move in a direction against the intention of the operator who is manually operating the back door 30, thus eliminating the risk of incurring a danger of nipping or the like. Further, the back door 30 does not automatically move in the same direction as a direction of the manual operation for the back door 30, thus eliminating the risk of bringing a feeling of strangeness to the operator who is performing the manual operation.

From the above, it is possible to improve the usability of the back door 30 by prioritizing the manual operation of opening or closing the back door 30 even when the BD opening/closing SW 3*b*, 4*b*, 6*b* is operated in the power assisting state.

Further, in an illustrative embodiment, in the power assisting mode, the target assisting force calculator 1*e* calculates the target assisting force in accordance with the manual operation of opening or closing the back door 30. Then the assisting force controller 1*f* controls the driving of the motor 20 based on that target assisting force and the motor current detected in the current detector 2*a*. Hence it is possible to assist the manual operation of opening or closing the back door 30, so as to reduce the operator's load.

Further, in an illustrative embodiment, in the auto-opening/closing mode, the speed controller 1*d* controls the driving of the motor 20 in accordance with the opening/closing operation of the BD opening/closing SW 3*b*, 4*b*, 6*b*, and it is thus possible to automatically open or close the back door 30 while performing speed control. Moreover, when the BD opening/closing SW 3*b*, 4*b*, 6*b* is re-operated during such automatic opening/closing of the back door 30, the speed controller 1*d* controls the driving of the motor 20 in accordance with that re-operation. Hence it is possible to stop the back door 30 at the desired intermediate position in accordance with the stopping operation in the BD opening/closing SW 3*b*, 4*b*, 6*b*, and it is possible to reverse the operating direction of the back door 30 in accordance with a reverse operation in the BD opening/closing SW 3*b*, 4*b*, 6*b*. From the above, it is possible to improve the usability of the back door 30 also in the auto-opening/closing state.

Further, in an illustrative embodiment, it is not only that the BD opening/closing SWs 3*b*, 4*b* are provided in the driver's seat operation part 3 and the back operation part 4, but that the BD opening/closing SW 6*b* is also provided in the remote controller 6. This increases the possibility that in a state where the operator being behind the vehicle is performing the manual operation of opening or closing the back door 30, another user being in a position apart from the back door 30 operates the BD opening/closing SW 6*b* of the remote controller 6 without being aware of the existence of the operator.

However, in an illustrative embodiment, even when the BD opening/closing SW 6*b* is operated in the power assisting state, the speed controller 1*d* does not control the driving of the motor 20 in accordance with that operation, and the power assisting state is continued. Accordingly, the back door 30 does not automatically move or stop against the intention of the operator, thus not causing a danger or not bringing a feeling of strangeness to the operator. Hence it is possible to improve the usability of the back door 30 by prioritizing the manual operation of opening or closing the back door 30 even when the BD opening/closing SW 6*b* of the remote controller 6 is operated in the power assisting state.

Although a traveling state of the vehicle is not considered in an illustrative embodiment, opening or closing of the back door 30 may be controlled in consideration of a traveling or stopping state of the vehicle as in one or more embodiments of the.

Figure 11:
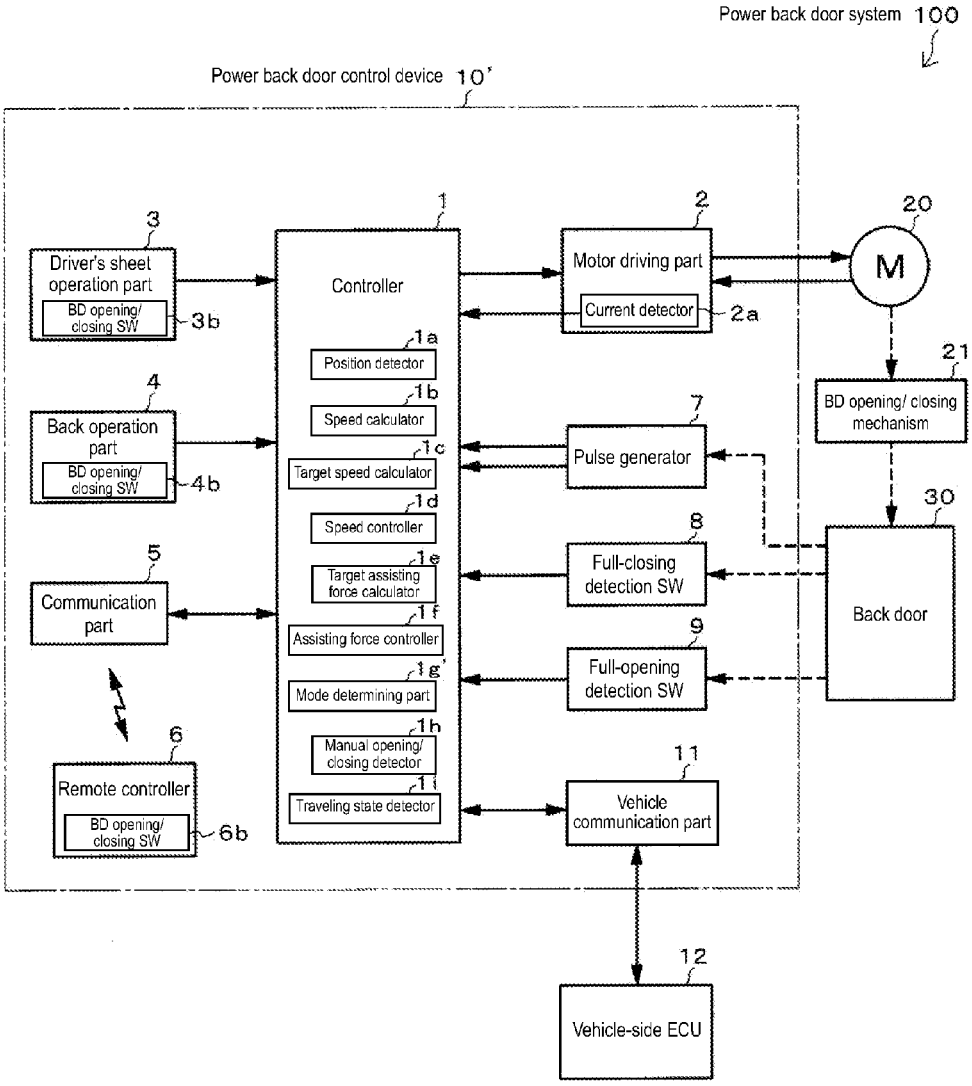
FIG. 11 is a diagram showing a configuration of a power back door control device according to one or more embodiments of the disclosure.

FIG. 11 is a diagram showing a configuration of a power back door control device 10' according to one or more embodiments of the disclosure. The power back door control device 10' is provided with a traveling state detector 1*i* and a vehicle communication part 11 in addition to the foregoing configuration.

The power back door control device 10' is connected with a vehicle-side ECU (Electric Control Device) 12, a CAN (Controller Area Network), and the like. Vehicle information concerning traveling and stopping of the vehicle is transmitted as needed from the vehicle-side ECU 12 to the power back door control device 10'. The information includes a vehicle speed, states of an accelerator and a brake, and the like, for example. The vehicle communication part 11 receives the information transmitted from the vehicle-side ECU 12. The vehicle-side ECU 12 is one example of the "vehicle-side device" of the disclosure.

The traveling state detector 1*i* is provided in the controller 1. The traveling state detector 1*i* detects whether or not the vehicle is traveling based on the vehicle information acquired by the vehicle communication part 11 from the vehicle-side ECU 12. A mode determining part 1*g'* of the controller 1 performs the mode determining process in consideration of the traveling or stopping state of the vehicle, detected by the traveling state detector 1*i* (Step S2 of FIG. 3).

Figure 12:
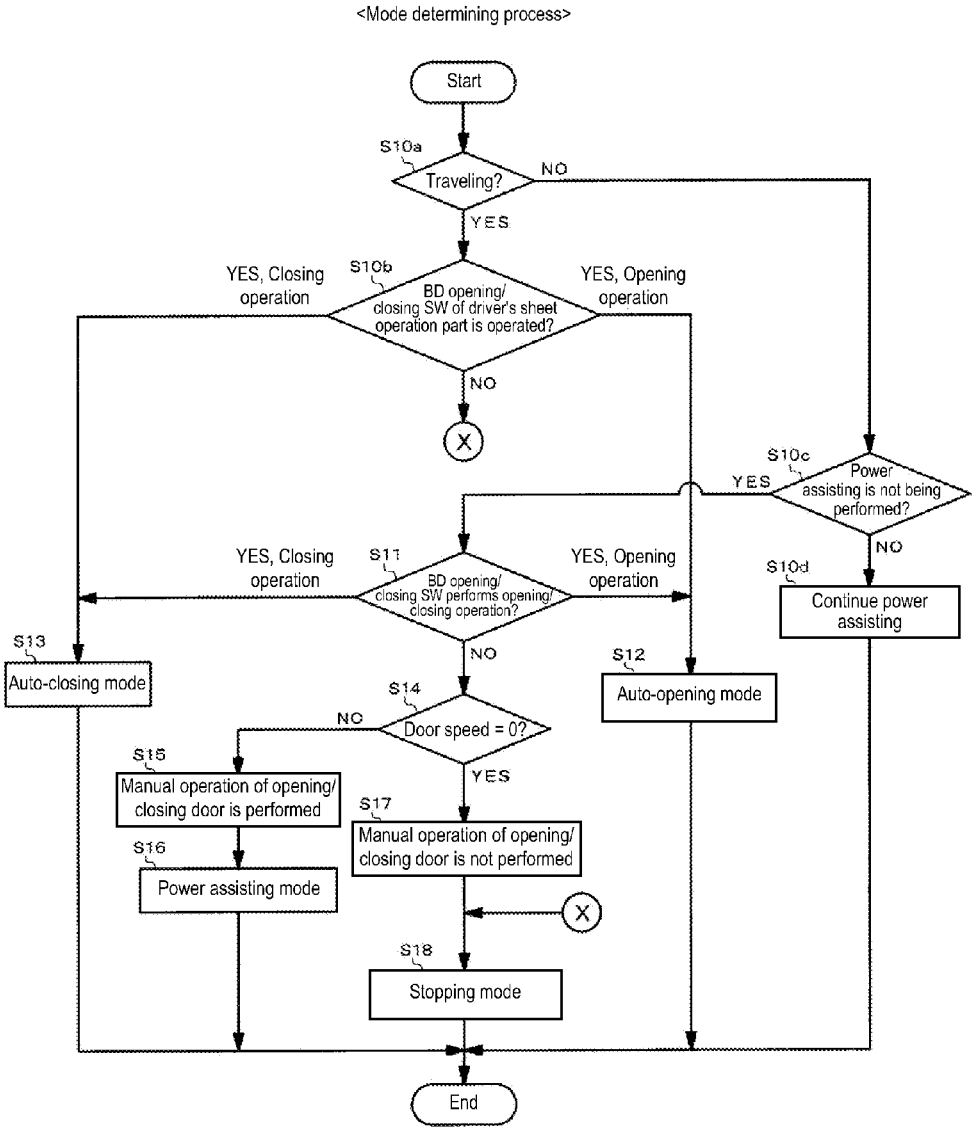
FIG. 12 is a flowchart showing a detail of a determining process of the power back door control device of FIG. 11.

FIG. 12 is a flowchart showing a detail of the mode determining process performed by the mode determining part 1*g'*. For example, when the vehicle speed of the vehicle acquired from the vehicle-side ECU 12 is other than 0, the traveling state detector 1*i* detects that the vehicle is traveling (Step S10*a* of FIG. 12: YES).

When the opening/closing operation is not performed in the BD opening/closing SW 3*b* of the drivers sheet operation part 3 during the traveling of the vehicle (S10*b* of FIG. 12: NO), the mode determining part 1*g'* determines that the switching destination is the stopping mode (Step S18 of FIG. 12).

In contrast, when the opening operation is performed in the BD opening/closing SW 3*b* of the drivers sheet operation part 3 during the traveling of the vehicle (Step S10*b* of FIG. 12: YES, auto-opening operation), the mode determining part 1*g'* determines that the switching destination is the auto-opening mode (Step S12 of FIG. 12). Further, when the closing operation is performed in the BD opening/closing SW 3*b* (Step S10*b* of FIG. 12: YES, auto-closing operation), the mode determining part 1*g'* determines that the switching destination is the auto-closing mode (Step S13 of FIG. 12). As thus described, when the auto-opening mode or the auto-closing mode is determined during the traveling of the vehicle, the auto-opening process of FIG. 5 or the auto-closing process of FIG. 6 is executed. The speed controller 1*d* controls the driving of the motor 20, and the back door 30 is automatically opened or closed.

It is to be noted that in the above, only the opening/closing operation of the BD opening/closing SW 3*b* of the driver's sheet operation part 3 is accepted during the traveling of the vehicle, and in accordance with the operation, the back door 30 is automatically opened or closed. However, as another example, the opening/closing operation of the BD opening/closing SW 6*b* of the remote controller 6 may also be accepted during the traveling of the vehicle, and in accordance with the operation, the back door 30 may be automatically opened or closed.

In contrast, for example when the vehicle speed of the vehicle acquired from the vehicle-side ECU 12 is 0, the traveling state detector 1*i* detects that the vehicle is not traveling (stopping) (Step S10*a* of FIG. 12: NO).

When the power assisting process of FIG. 8 is executed and the assisting force controller 1*f* is performing opening/closing driving of the motor 20 so as to assist the manual opening/closing operation of the back door 30 during the stopping of the vehicle (Step S43 or S47 of FIG. 8), the controller 1 determines that the power assisting is being performed (Step S10*c* of FIG. 12: NO). The controller 1 then continues the power assisting process (Step S10*d* of FIG. 12). Thereby, when the vehicle is being stopped and the power assisting is being performed, even when any of the BD opening/closing SWs 3*b*, 4*b*, 6*b* is operated, speed controller 1*d* does not control the driving of the motor 20 in accordance with the operation, but the assisting force controller 1*f* continues to control the driving of the motor 20.

Further, when the power assisting process of FIG. 8 is not executed and the assisting force controller 1*f* is not performing opening/closing driving of the motor 20 so as to assist the manual opening/closing operation of the back door 30 during the stopping of the vehicle, the controller 1 determines that the power assisting is not being performed (Step S10*c* of FIG. 12: YES). Then, as described in FIG. 4, the processes of Steps S11 to S18 are executed. That is, based on the opening/closing operations of the BD opening/closing SWs 3*b*, 4*b*, 6*b* and the door speed, the mode determining part 1*g*' determines that the switching destination is the auto-opening mode (Step S12 of FIG. 12), the auto-closing mode (Step S13 of FIG. 12), the power assisting mode (Step S16 of FIG. 12) or the stopping mode (Step S18 of FIG. 12). Then, in accordance with a result of this judgment, the auto-opening process, the auto-closing process or the power assisting process is executed, or the back door 30 is held standing still at the intermediate position.

According to one or more embodiments of the disclosure, in the case where the vehicle is being stopped and the power assisting is being performed, the power assisting state is continued even when any of the BD opening/closing SWs 3*b*, 4*b*, 6*b* is operated for opening or closing. For this reason, the back door 30 does not move in a direction against the intention of the operator who is manually operating the back door 30, thus eliminating the risk of incurring a danger of nipping or the like and bringing a feeling of strangeness to the operator. Hence it is possible to improve the usability of the back door 30 by prioritizing the manual operation of opening or closing the back door 30 even when the BD opening/closing SW 3*b*, 4*b*, 6*b* is operated in the power assisting state.

Further, in an illustrative embodiment, in the case where the vehicle is being stopped and the power assisting is not being performed, when any of the BD opening/closing SWs 3*b*, 4*b*, 6*b* is operated for opening or closing, the back door 30 is automatically opened or closed in accordance with the operation. That is, since the back door 30 is automatically opened or closed by the operation of the BD opening/closing SW 3*b*, 4*b*, 6*b*, it is possible to improve the usability of the back door 30.

Further, in an illustrative embodiment, when the BD opening/closing SW 3*b* of the drivers sheet operation part 3 is operated for opening or closing during the traveling of the vehicle, the back door 30 is automatically opened or closed. Therefore, for example, even when the vehicle is allowed to travel in a state where the back door 30 is not fully closed, the back door 30 can be fully closed by the operator performing the closing operation on the BD opening/closing SW 3*b* during the traveling. Further, during the traveling of the vehicle, for example, the back door 30 being at the intermediate position can be opened or closed to a predetermined position by the operation of the BD opening/closing SW 3*b*.

The disclosure is applicable to a variety of embodiments other than those described above. For example, in an illustrative embodiment, the example is shown where the manual opening/closing detector 1*h* detects the manual operation of opening or closing the back door 30 based on the opening/closing speed (door speed) of the back door 30 calculated by the speed calculator 1*b*, but the disclosure is not restricted only to this. Other than this, for example, the manual opening/closing detector 1*h* may detect the manual operation of opening or closing the back door 30 based on a temporal change in the opening/closing position (door position) of the back door 30 detected by the position detector 1*a*. Further, for example, a sensor for sensing force, such as a force sensor, may be provided in the gripper of the back door 30, and based on an output signal of that sensor, the manual opening/closing detector 1*h* may detect the manual operation of opening or closing the back door 30.

Further, in an illustrative embodiment, the example is shown where the position detector 1*a* detects the opening/closing position of the back door 30 based on outputs of the pulse generator 7, the full-closing detection SW 8 and the full-opening detection SW 9, but the disclosure is not restricted only to this. Other than this, for example, the position detector may detect the opening/closing position of the back door based on outputs from the sensor or a switch, a current flowing in the motor or a frequency of a ripple included in the current flowing in the motor.

Further, the flip-up back door 30 is shown as the example in an illustrative embodiment, but the disclosure is not restricted only to this, and a back door of a type other than this may be used.

Further, in an illustrative embodiment, the example is cited where the disclosure is applied to the power back door control device 10 of the automatic four-wheel car, but this is not restrictive. For example, the disclosure is also applicable to a door opening/closing control device such as a power slide door control device that opens or closes a slide door. Moreover, the disclosure is also applicable to a door opening/closing control device that opens or closes a door by an actuator other than the motor.

While the invention has been described with reference to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A door opening and closing control device, comprising:

a driving part configured to drive an actuator that opens or closes a door;

an operation switch configured to accept an operation for opening, closing, or stopping movement of the door, and to send an instruction indicating the operation;

a first controller configured to control driving of the actuator via the driving part in accordance with the instruction indicating the operation of the operation switch;

a manual opening or closing detector configured to detect that the door is manually opened or closed; and a second controller configured to control the driving of the actuator via the driving part so as to assist a manual operation of opening or closing the door when the manual opening or closing detector detects the manual opening or closing operation, wherein, while the second controller is controlling the driving of the actuator so as to assist the manual operation of opening or closing the door, operation of the operation switch is ignored or invalidated, such that the first controller does not control the driving of the actuator in accordance with the instruction indicating the operation, and the second controller continues to control the driving of the actuator.

2. The door opening and dosing control device according to claim 1, further comprising:

a position detector configured to detect an opening or closing position of the door;

a speed calculator configured to calculate an opening or closing speed of the door based on a temporal change in the opening or closing position detected by the position detector; and a target speed calculator configured to calculate a target speed based on the opening or closing position detected by the position detector, wherein the first controller controls the driving of the actuator based on the opening dosing speed calculated by the speed calculator and the target speed calculated by the target speed calculator.

3. The door opening and closing control device according to claim 2, further comprising:

a target assisting force calculator configured to calculate target assisting force based on the opening or closing position detected by the position detector and the opening or closing speed calculated by the speed calculator; and a current detector configured to detect a driving current of the actuator, wherein the second controller controls the driving of the actuator based on the target assisting force calculated by the target assisting force calculator and the driving current detected by the current detector.

4. The door opening and closing control device according to claim 1, wherein at the time of the first controller controlling the driving of the actuator so as to perform the operation of opening or closing the door in accordance with the instruction indicating the operation of the operation switch, and wherein, when re-operation of the operation switch is performed during automatic opening or closing of the door, the first controller controls the driving of the actuator in accordance with an instruction indicating the re-operation of the operation switch.

5. The door opening and closing control device according to claim 1, further comprising:

a remote controller which is provided with the operation switch and configured to wirelessly transmit an operation signal that shows an operating state of the operation switch; and a communication part configured to receive the operation signal transmitted from the remote controller, wherein, when the communication part receives the operation signal from the remote controller, wherein, unless the second controller is controlling the driving of the actuator so as to assist the manual operation of opening or closing the door, wherein the first controller controls the driving of the actuator in accordance with the operation signal.

6. The door opening and closing control device according to claim 1, which controls opening and closing of the door provided on a vehicle, the door opening or closing control device further comprising a traveling state detector configured to detect whether or not the vehicle is traveling based on information concerning traveling and stopping of the vehicle, the information is acquired from a vehicle-side device, wherein, at the time of the traveling state detector detecting non-traveling of the vehicle and the second controller controlling the driving of the actuator so as to assist the manual operation of opening or closing the door, even when the operation switch is operated, the first controller does not control the driving of the actuator in accordance with the instruction indicating the operation, and the second controller continues to control the driving of the actuator, wherein, at the time of the traveling state detector detecting non-traveling of the vehicle and the second controller not controlling the driving of the actuator so as to assist the manual operation of opening or closing the door, when the operation switch is operated, the first controller controls the driving of the actuator in accordance with the instruction indicating the operation, and wherein, at the time of the traveling state detector detecting traveling of the vehicle, when the operation switch is operated, the first controller controls the driving of the actuator in accordance with the operation.

7. The door opening and closing control device according to claim 5, wherein the operation switch is provided in at least each of an operation part in the driver's seat and the remote controller of the vehicle, wherein at the time of the traveling state detector detecting traveling of the vehicle, the first controller controls the driving of the actuator in accordance with an instruction indicating the operation of the operation switch of the operation part in the driver's seat, and wherein at the time of the traveling state detector detecting non-traveling of the vehicle and the second controller not controlling the driving of the actuator so as to assist the manual operation of opening or closing the door, the first controller controls the driving of the actuator in accordance with an instruction indicating the operation of the operation switch of the operation part in the driver's seat or of the operation switch of the remote controller.

* * * * *